United States Patent [19]

Schunk et al.

[11] Patent Number: 4,794,766

[45] Date of Patent: Jan. 3, 1989

[54] FINGER RING WITH INTERCHANGEABLE STONE

[76] Inventors: Shane P. Schunk, 5858 Folkstone La., Orlando, Fla. 32822; Jackson E. Schunk, Shi-Sul (La60 Sul), OI-15 Chacara 62, Brasilia, D.F., Brazil

[21] Appl. No.: 187,313

[22] Filed: Apr. 28, 1988

[51] Int. Cl.[4] ..... A44C 9/00

[52] U.S. Cl. ..... 63/15; 63/29.1

[58] Field of Search ..... 63/15.1, 15.2, 15.3, 63/15, 26, 27, 29.1

[56] References Cited

U.S. PATENT DOCUMENTS 1,971,265 8/1934 King ..... 63/15

FOREIGN PATENT DOCUMENTS 650472 1/1929 France ..... 63/29.1

801389 8/1936 France ..... 63/29.1

*Primary Examiner*—Francis K. Zugel

*Assistant Examiner*—Laurie K. Cranmer

[57] ABSTRACT

A finger ring with interchangeable stone has a finger encircling ring body with an enlarged portion having a stone setting attached thereto. A pair of V-shaped stone clamps have apexes pivotally attached to the ring body and end hooks for engaging facets of a selected stone. A threaded boss is attached to said ring body on each side of said stone setting and each accepts a clamping screw having an enlarged decorative head. The clamping screw passes through a stone clamp and threadedly engages a boss to cause the clamp hooks to secure the selected stone in the setting. By loosening the clamping screws, the stone can be quickly changed.

7 Claims, 1 Drawing Sheet

FINGER RING WITH INTERCHANGEABLE STONE

BACKGROUND OF THE INVENTION

1. Field of the Invention

The present invention relates to an interchangeable stone setting and more particularly, to a finger ring in which the jewel stone may be readily changed.

2. Description of the Prior Art

It is desirable to provide a finger ring in which the jewel stone can be readily removed and another type or color of stone installed. This type of ring will permit a wearer to match other jewelry articles, clothing or accessories. While it is known in the art to provide rings in which the ornamental part can be changed, most are relatively complicated and costly to manfacture.

Elliot, in U.S. Pat. No. 899,296, shows a ring which is split diametrically and hinged opposite the stone. The stone and setting is removable. Obsboum, U.S. Pat. No. 1,152,340, also teaches a diametrically split ring with a hinge or pivot immediately below the stone. The split ends opposite the stone, when unlocked swing inwardly to release the stone. Estrin et al., U.S. Pat. No. 3,307,375, disclose a ring split equatorially and hinged opposite the stone. The stone is in a special setting and is interchangeable.

Greenfield, U.S. Pat. No. 1,434,886, teaches a ring having a setting which is screwed into the ring with means for closing a set of prongs onto a stone when the setting is screwed downwardly. Rings for a spherical stones are shown in U.S. Pat. No. 3,653,227 to Ricci, and in U.S. Pat. No. 3,693,376 to Willner. Each depends upon the elasticity of the ring material to permit spherical stones to be snapped in and out of the setting.

There is a need for a simple low cost ring in which the stone is easily changeable and in which the stone is held securely.

SUMMARY OF THE INVENTION

The present invention provides a ring forming a complete band around the finger. The stone setting is in the form of a basket disposed on a widened portion of the ring into which the stone is to be placed. On either side of the stone basket and spaced circumferentially from the basket, a pivot eye is disposed. Between each pivot eye and the stone basket, a radially projecting boss having internal threads is provided.

An approximately V-shaped stone clamp formed from wire is pivotally attached to each pivot eye. The distal ends of the vee are bent and formed into hooks. A pair of clamping screws is provided in which each includes a threaded stud to fit the threaded boss and a greatly enlarged decorative head. For example, a circular floral or leaf motif may be used for the screw head with a small stone or other decorative elements attached thereto.

A stone to be installed is placed in the stone basket. The two V-shaped clamps are swung toward the stone so as to place the vee-ends on the edges of the stone. The two clamping screws are placed on the clamps with the stud projecting between the vee legs. The clamping screw is tightened down placing the stone clamp under compression and causing the hook positions of the stone clamps to securely hold the stone in place.

To change the stone, it is necessary to only loosen the clamping screws sufficiently to permit removal of the stone and substitution of another.

As will be recognized, a simple, low cost structure is provided which requires no accurate machining of components, and which eliminates complex hinges, locks and clamps.

It is therefore a principal object of the invention to provide a simple, low cost finger ring which will permit the jewel stone to be easily changed.

It is another object of the invention to provide an interchangeable stone type finger ring having no splits in the ring and in which pivoted stone clamps are held against a stone by decorative clamping screws.

These and other objects and advantages of the invention will become apparent from the following detailed description when read in conjunction with the drawings.

DETAILED DESCRIPTION OF THE PREFERRED EMBODIMENT

Figure 1:
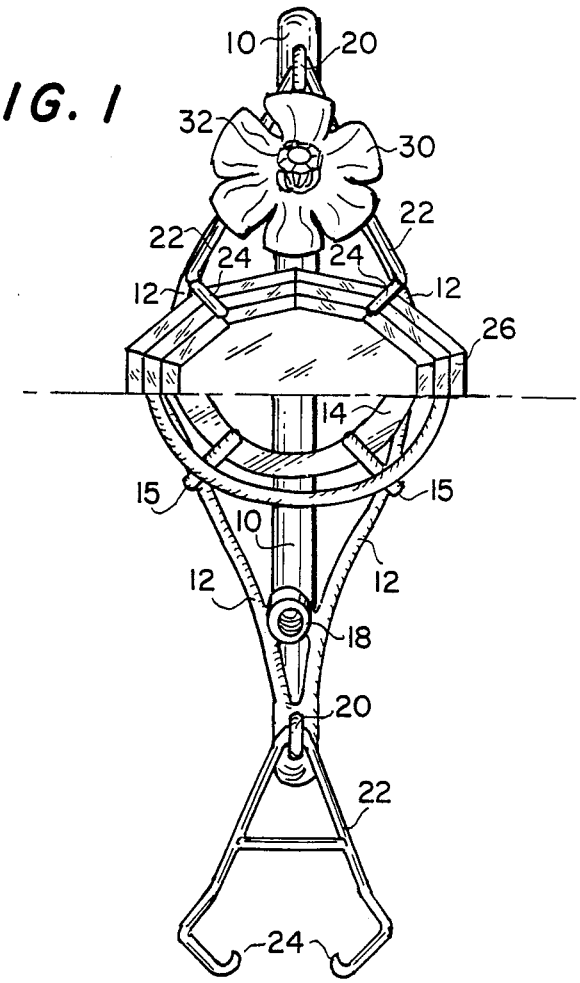
FIG. 1 is a top view of a ring in accordance with the invention in which a jewel stone is cut away on one side showing a stone clamp in an open position.
Figure 2:
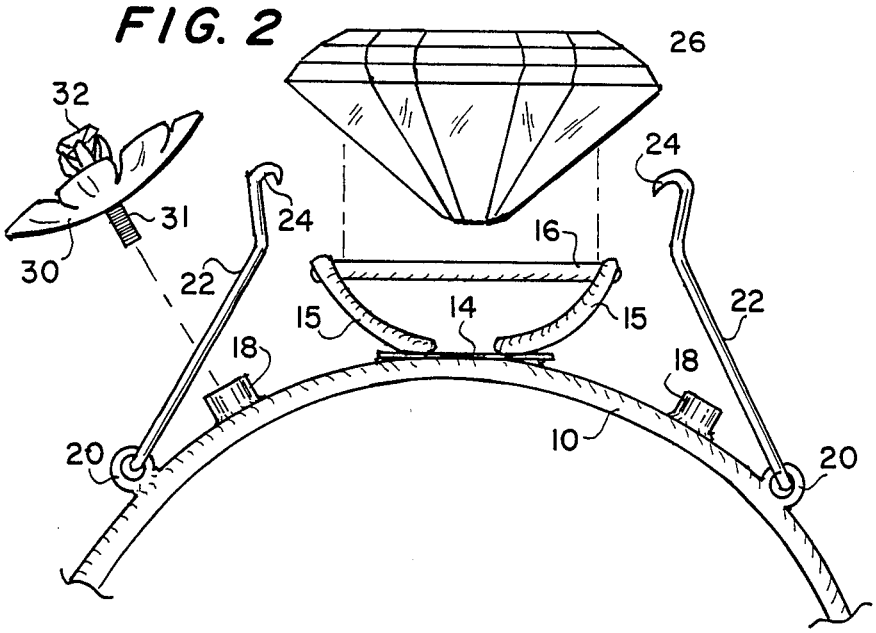
FIG. 2 is an exploded side view of the ring of FIG. 1 showing one of the clamping screws.

Referring to FIG. 1, an exemplary embodiment 15 of the invention is shown in top view with a jewel stone 26 partially cut away to disclose details of the mounting 1. A finger-encircling ring body 10 is provided which, in the example, includes an upper portion formed by members 12 that provide a base for mounting 11. Mounting 11, as seen partially in FIG. 1 and in side view of FIG. 2, includes an elliptical base plate 14 attached to members 12 and a set of basket supports 15. Supports 15 are attached to a basket 16 which is shaped to accept the base of stone 26.

A boss 18 is attached to and extends radially from ring body 10 on either side of mounting 11. As may be seen in FIG. 1, boss 18 is attached between members 12. However, it is to be understod that other designs of ring body 10 are included in the invention and any desired shape or structure or the top area of ring body 10 may be used.

A pivot eye 20 is attached to ring body 10 on either side of bosses 18. A V-shaped stone clamp member 22, seen in plan view in FIG. 1 and in side view in FIG. 2, has a proximal apex end and a distal stone engaging end. Stone clamp member 22 is disposed with its apex pivotally engaging eye 20. The outer ends of stone clamp member 22 are bent into hooks 24 which engage the edges of stone 26 as shown in FIG. 1. A pair of decorative clamping screws 30, one of which is seen in top view of FIG. 1 and side view in FIG. 2, each have a threaded stud 31 and a head portion 33 which is preferably of a decorative appearance. For example, in FIGS. 1 and 2, head portion 33 of clamping screws 30 are in the form of a flower with head portion 33 forming petals with a small stone 32 mounted in the center. However, any suitable head portion design may be used in accordance with the invention.

Stone 26 is placed in mounting 11 and stone clamp members 22 are closed to engage the outer facets of stone 26 by hooks 24. Clamping screws 30 are installed on bosses 18 and tightened to cause hooks 24 to securely grip stone 26. Clamp members 22 and hooks 24 are formed so as to produce a slight amount of tension when two clamping screws 30 are fully seated in bosses 18. If desired, clamping screws 30 may be captivated in bosses 18 such that loosening of screws 30 will permit removal and replacement of stone 26 without removal of threaded stud 31.

As will now be recognized, a user may purchase a single finger ring in accordance with the invention and a plurality of stones of varying colors and designs. The user may then select a stone most suitable for a given costume or accessories and install that stone in the finger ring. Although a preferred embodiment has been disclosed for exemplary purposes, many variations in the implementation of the invention will occur to those of skill in the art and which may be incorporated without departing from the spirit and scope of the invention.

We claim:

1. A ring having an interchangeable stone comprising:

a finger encircling ring;

a setting for a stone attached to said ring;

a pair of pivot eyes, one of said pivot eyes attached to said ring on either side of said setting and circumferentially spaced therefrom;

a pair of radially projecting bosses having internal threads therein, one of said bosses attached to said ring on either side of said setting and between said pivot eye and said setting;

a pair of approximately V-shaped stone clamps, each having an apex portion pivotally engaging one of said pivot eyes, and a pair of distal ends forming stone engaging hooks; and a pair of clamping screws, each of said screws for threadedly engaging one of said bosses and one of said stone clamps;

whereby a selected stone is removably disposed in said mounting, each of said stone clamps disposed to cause said hooks to engage facets of said stone, and each of said clamping screws threaded into one of said bosses for compressing said stone clamp for holding said stone in said setting.

2. The ring as recited in claim 1 in which said setting includes:

a base plate attached to said ring;

a basket formed to accept the base of a stone; and a set of basket supports disposed between said base plate and said basket.

3. The ring as recited in claim 1 in which said clamping screw includes an enlarged decorative head.

4. A finger ring comprising:

a finger ring body, said body having an enlarged portion for mounting of a stone;

a stone-supporting member attached to said enlarged portion of said ring body;

a pair of stone clamp members each having a proximal end and a distal end, said distal end including stone engaging hooks wherein one of said clamp members is disposed with said proximal end pivotally attached to said ring body on either side of said stone-supporting member and circumferentially spaced therefrom, and each having an opening therethrough;

a pair of internally threaded bosses attached to said ring body wherein one of said bosses is disposed on either side of said stone supporting member;

a selected stone temporarily disposed in said stone-supporting member, said pair of stone clamp members having said stone engaging hooks engaging said stone; and a pair of clamping screws, each engaging one of said bosses through one of said stone clamp member openings thereby placing said stone engaging hooks under compression for holding said selected stone in said stone-supporting member.

5. The ring as recited in claim 4 in which said ring body is finger encircling.

6. The ring as recited in claim 4 in which said stone clamp members are V-shaped.

7. The ring as recited in claim 4 in which said clamping screws have enlarged decorative heads.

* * * * *